US005468398A

United States Patent [19]

Farooq et al.

[11] Patent Number: 5,468,398

[45] Date of Patent: Nov. 21, 1995

[54] LIQUID FABRIC SOFTENING COMPOSITION

[75] Inventors: Amjad Farooq, Somerset; Ammanuel Mehreteab, Piscataway, both of N.J.; Guy Broze, Grace-Hollogne, Belgium; Cristina Bielli, Morganville, N.J.

[73] Assignee: Colgate-Palmolive Company, New York, N.Y.

[21] Appl. No.: 65,207

[22] Filed: May 20, 1993

[51] Int. Cl.[6] ..... D06M 13/10; D06M 13/352

[52] U.S. Cl. ..... 252/88; 252/8.6; 252/8.9

[58] Field of Search ..... 252/8.6, 8.8, 8.9

[56] References Cited

U.S. PATENT DOCUMENTS

| | | | |
|---|---|---|---|
| 4,661,267 | 4/1987 | Dekker et al. | 252/8.8 |
| 4,724,089 | 2/1988 | Konig et al. | 252/8.8 |
| 4,772,404 | 9/1988 | Fox et al. | 252/8.8 |
| 4,963,274 | 10/1990 | Ruback et al. | 252/8.75 |
| 4,999,121 | 3/1991 | De Block et al. | 252/8.8 |
| 5,114,600 | 5/1992 | Biggin et al. | 252/8.6 |
| 5,116,520 | 5/1992 | Lichenwalter et al. | 252/8.6 |
| 5,126,061 | 6/1992 | Michael | 252/8.6 |
| 5,133,885 | 7/1992 | Contor et al. | 252/8.6 |
| 5,180,508 | 1/1993 | Birkhan et al. | 252/8.8 |
| 5,182,033 | 1/1993 | Lagerman | 252/8.6 |
| 5,232,612 | 8/1993 | Trinh et al. | 252/8.6 |

FOREIGN PATENT DOCUMENTS

| | | |
|---|---|---|
| 8800990 | 2/1988 | European Pat. Off. . |
| 295386 | 12/1988 | European Pat. Off. . |
| 303473 | 2/1989 | European Pat. Off. . |
| 413249 | 2/1991 | European Pat. Off. . |
| 443313 | 8/1991 | European Pat. Off. . |
| 534009 | 3/1993 | European Pat. Off. . |
| 2173827 | 10/1986 | United Kingdom . |

*Primary Examiner*—Paul Lieberman
*Assistant Examiner*—Michael Tierney
*Attorney, Agent, or Firm*—Bernard Lieberman; Henry S. Goldfine; Robert C. Sullivan

[57] ABSTRACT

The pourability and softening performance of amidoamine fabric softeners, such as bis(hydrogenated tallow amidoethyl)-2-hydroxyethyl amine) is improved by incorporating certain cyclic imidazolinium compounds such as, 1-methyl-2-nortallow-1(2-tallow amidoethyl) imidazolinium methosulfate. The compositions may be highly concentrated for use at low levels or for further dilution prior to use.

13 Claims, No Drawings

LIQUID FABRIC SOFTENING COMPOSITION

FIELD OF THE INVENTION

This invention relates to liquid fabric softening compositions. More particularly, the invention relates to ready-for-use (or dilute before use) and concentrated liquid fabric softening compositions which are effective in softening fabrics in both soft and hard water and which are primarily intended as rinse cycle fabric softening compositions.

BACKGROUND OF THE INVENTION

Compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g., biodegradability) of the quaternary compound softeners, as well as limits in the amounts of these cationic compounds which can be stably incorporated into the more convenient to use liquid formulations, there have been many proposals for partial or total replacements for the conventional "quat" fabric softeners which are exemplified by dimethyl distearyl (or ditallow) ammonium chloride and various imidazolinium compounds.

For instance in GB 2,032,479A, corresponding to EP 038862, to D. Fontanesi (assigned to Albright & Wilson Ltd.) water dispersible unquaternized hydroxyalkyl diamidoamine compounds of formula $$RNH((CH_2)_nNR)_mR$$

wherein an average of from 20% to 80% of the R groups are $C_{12}$ to $C_{22}$ acyl, at least 20% of the R groups are $—CH_2CH_2OH$ or $—CH_2CHOHCH_3$ or mixtures of these groups, and any other R group is hydrogen, n is 2 or 3 and m is an integer of from 2 to 5, are provided as mobile pastes in the presence of lower alkanol solvents. This is stated to be in contrast to partially neutralized unquaternized diamidoamines which, while providing highly effective fabric softening properties, are too viscous even when diluted in the lower alkanol solvents for convenient handling.

U.S. Pat. No. 5,154,838 (corresponding to EP 0459211A2) to Yomamura, et al. (assigned to Kao Corp.) discloses an aqueous liquid softener composition based on an amidoamine compound which is the condensation reaction product of a di- or tri-amine of formula (I)

$$R^1NH(C_mH_{2m}NH)_nH \quad (I)$$

with a fatty acid of formula (II)

$$R^2\underset{\underset{O}{\|}}{C}—OH \quad (II)$$

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amidoamine compound is used in the form of its neutral salt.

In U.S. Pat. No. 5,133,885 to L. Contor, et al. (assigned to Colgate-Palmolive Co., the assignee of the present invention) fabric softening compositions are described which are aqueous dispersions of a fatty acid ester quat of formula

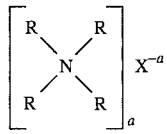

where one or two R groups represent an aliphatic ester residue of from 12 to 30 carbon atoms of formula $-(CH_2)_nOCOR_4$, and the remaining R groups represent lower aliphatic, aralkyl or hydroxyalkyl groups, $X^-$ is an anion and "a" represents the ionic valence of the anion, and a fatty acid amidoamine softener of formula $$R^1CONH(CH_2)_mN(R^2)—R^3$$

where $R^1$ is a $C_{12}$ to $C_{30}$ alkyl or alkenyl group, $R^2$ represents $R^1$,$R^1CONH(CH_2)_m$ or $CH_2CH_2OH$; $R^3$ represents hydrogen, methyl or $(CH_2CH_2O)_pH$, m is a number of 1 to 5 and p is a number of 1 to 5, at a weight ratio of ester quat to amidoamine of from 10:1 to 1:10.

U.S. Pat. No. 4,772,403 to Grandmaire, et al. (Colgate-Palmolive Co.) discloses aqueous fabric softening compositions, especially adapted for use in the rinse cycle of a laundering process. These compounds are based upon (i) cationic fabric softening compounds and (ii) fatty alcohol having an alkyl group of from about 10 to about 22 carbon atoms at an (i)=(ii) weight ratio of from 6:1 to about 2.8:1, and a total amount of (i) and (ii) of 3 to 20 weight percent. A minor amount of water soluble electrolyte and/or an ethoxylated amine can be used as optional ingredients, the latter as an emulsifier to further increase the stability against phase separation of the suspended phase of the formulation.

U.S. Pat. No. 5,108,628 to Uphues, et al. (Henkel) discloses certain aliphatic carboxylic acid amidoamines which are obtained by reaction of polyamines (e.g., diethylentriamine, aminoethyl ethanolamine) with carboxylic acid mixtures containing ether carboxylic acids ($R—O—(CH_2CH_2O)_n—CH_2COOH$, $R=C_{8-18}$ alkyl, $C_{8-18}$ alkenyl or $CH_2—COOH$, n=2 to 20, in combination with aliphatic $C_{8-22}$ monocarboxylic acids and/or amide-forming aliphatic $C_{8-22}$ monocarboxylic acid derivatives) as fabric softeners stable in the presence of electrolytes.

While these and many other proposals are known for improved fabric softening compositions, nevertheless, still further improvements are desired.

One such proposal is described by Schramm, et al. in the commonly assigned, copending application Ser. No. 07/995,102, filed Dec. 22, 1992. According to this proposal stable, aqueous, pourable and water dispersible, fabric softener compositions which include (A) a fabric softening effective amount of an inorganic or organic acid salt of a finely divided softening compound of formula (I):

$$R_1—CONH(CH_2)_n—N(R_3)—(CH_2)_mHNOC—R_2 \quad (I)$$

wherein $R_1$ and $R_2$, independently, represent $C_{12}$ to $C_{20}$ alkyl or alkenyl; $R_3$ represents $(CH_2CH_2O)_pH$, $CH_3$ or H; n and m are each a number of from 1 to 5; and p is a number of from 1 to 10; (B) a dispersant stabilizing effective amount of a dispersant having the formula (II) , (III), (IV) or (V) :

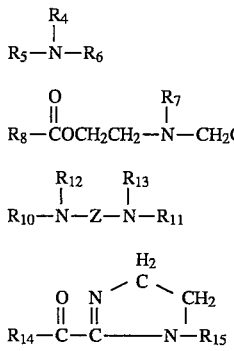

(II)

(III)

(IV)

(V)

wherein $R_4$ represents a hydrocarbon group having from 8 to 22 carbon atoms, $R_5$ represents a hydrocarbon group having from 1 to 22 carbon atoms, $R_6$ represents $C_1$-$C_4$ alkyl or hydroxyalkyl, $R_7$ represents $C_1$-$C_4$ alkyl or hydroxyalkyl, $R_8$ and $R_9$ each, independently represent a hydrocarbon group having from 8 to 22 carbon atoms, $R_{10}$ represents a hydrocarbon group having from 8 to 22 carbon atoms, $R_{11}$ represents a hydrocarbon group having from 1 to 22 carbon atoms which may have an hydroxyl group substituent, $R_{12}$ and $R_{13}$, independently, represent $C_1$-$C_4$ alkyl or hydroxyalkyl, Z represents a divalent alkylene group of from 1 to 6 carbon atoms, or an hydroxyl substituted alkylene group;

$R_{14}$ represents a hydrocarbon group having from 8 to 22 carbon atoms;

$R_{15}$ represents a hydrogen atom or $C_1$-$C_4$ alkyl or hydroxyalkyl; and (C) an aqueous solvent, were provided as ready-to-use products or as concentrates to be used at reduced levels or which may be diluted with water prior to use at the same or similar levels as the ready-to-use products. In the ready-to-use composition the total amount of amidoamine softener (A) and stabilizing dispersant (B) is generally in the range of from about 2 to 8% by weight. In the concentrated form the total amount of (A) and (B) is generally in the range of from about 12 to 60% and may be diluted at ratios of water:concentrate as high as about 4:1 to even 8:1 or 9:1, and still provide acceptable softening performance, equivalent or better than that achieved using conventional quaternary cationic surfactant softeners, such as dimethyl distearyl ammonium chloride (DMDSAC).

An especially preferred composition according to the prior proposal of Schramm, Jr., et al. (in terms of a ready-to-use formula or dilutable concentrate) includes the following ingredients:

(A) from about 2 to 8% by weight of a salt of bis(hydrogenated tallow amidoethyl)-2-hydroxyethyl amine;

(B) from about 0.2 to 1.5% by weight of a stabilizing dispersant compound selected from dimethyl hydrogenated tallow amine, methyl dihydrogenated tallow amine, N,N'N'-tris(2-hydroxyethyl)-N-tallow-1,3-diaminopropane, and oleic imidazoline;

(C) from about 0.5 to 5% of $C_2H_5OH$, $C_3H_7OH$, or mixture thereof;

(D) 0 to about 2% of $C_6$ to $C_{16}$ fatty alcohol; and (E) from about 87 to 94% water; the composition having a pH of less than 4.

An alternative embodiment of the Schramm, Jr., et al. fabric softener aqueous liquid compositions which is adaptable for use in the rinse cycle of a laundering process and which is described as stable, pourable, and dispersible in water, includes the following ingredients:

(A') an inorganic or organic acid salt of bis(hydrogenated tallow amidoethyl) hydroxyethyl amine, (B') an inorganic or organic acid salt of bis(non-hydrogenated tallow amidoethyl) hydroxyethyl amine, with the total amount of (A') and (B') being from about 2% to about 50% by weight of the composition, and the ratio by weight of (A') to (B') being in the range of from about 10:1 to abut 1.5:1, and an aqueous solvent.

While the compositions disclosed in the aforesaid application Ser. No. 07/995,102 of Schramm, Jr., et al. provide highly effective stable and pourable liquid fabric softener compositions, it has been found, in practice, that with concentrations of the amidoamine fabric softening compound, e.g., Varisoft 510, in excess of 11 weight percent, the product viscosity becomes excessively high, even in the presence of electrolytes, e.g., $CaCl_2$, or solvents, e.g., propanol. While higher total concentrations of the amidoamine were achieved using the soft tallow product Varisoft 512 or mixtures of Varisoft 512 and hard tallow product, Varisoft 510, the softening performance of the Varisoft 512 containing compositions, presumably due to the lack of hydrogen bonding sites on the protonated soft tallow compound, was not sufficiently improved.

European Patent No. 413,249A1, published Feb. 20, 1991, describes a laundry softener composition with improved dispersibility and back wetting ability. In these compositions a fatty acid ester quat, e.g.

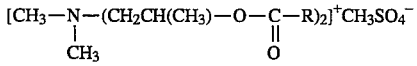

(R represents linear saturated or unsaturated aliphatic alkyl residue with 16 to 18 carbon atoms) is used in combination with an amine base structure, inclusive of various imidazole compounds, and amido tertiary amine compounds.

Therefore, the present inventors set out to provide ways to increase the concentration in the liquid fabric softening composition of the amidoamine softener compound Varisoft 510 in view of the very good environmental attributes and favorable acute toxicity data of this compound and its strong softening performance. As a result of these efforts many different types and classes of compounds and approaches were tested or considered. Among the classes of compounds tested as viscosity controlling agents in an effort to achieve stable, pourable, liquid compositions based on Varisoft 510 in amounts of 10 to 20% by weight mention can be made of hydrocarbons, e.g., paraffins, organic acids, e.g., citric acid, cationic alumina, cationic polymers and electrolytes, e.g., $CaCl_2$.

The viscosity of concentrated dispersions of softeners can be controlled by taking one of several suitable measures. For example Mourson and Stewart (U.S. Pat. No. 3,954,634) suggest producing the dispersion as usual by stirring the cationic softener raw material into water and subsequently homogenizing it under a pressure of 16–40 $N/mm^2$. Concentrations that were achieved by this method were 10–15%. Verbruggen (EP Patent 0013780) was able to prepare stable softener dispersions of low viscosity by the addition of antigelling agents, such as hydrocarbons, aliphatic fatty acids, and fatty acid methyl esters (2–4%). Concentrations of 12–20% were obtained in this way for imidoazoline and di-alkyl-ammonium compounds. The use of hydrocarbon materials such as paraffin oils and paraffin waxes is also claimed in British Patent 1,601,360. Gofbinet (EP 0,000, 406) used ethoxylated diamines, such as ethoxylated tallow propylene diamine or alkylpyridine compounds to obtain low viscosity, uniform and stable cationic dispersions up to 15% active ingredients level. In his paper Helmut Hein (Tenside Detergents 18 (1981) 5) refers to the use of ionogenic (organic ammonium compounds, see below) and simple non-ionogenic emulsifiers (such as Nonylphenol 10 Aeo, and Oleylalcohol 8 Aeo) for lowering the viscosity of fabric softener dispersions.

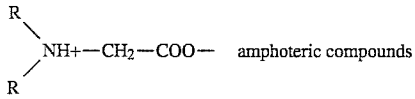

amphoteric compounds

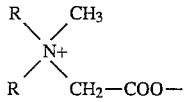

betaine

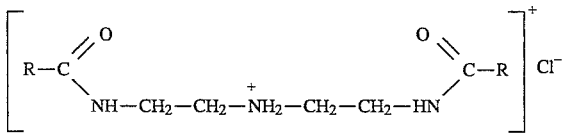

ammonium compound

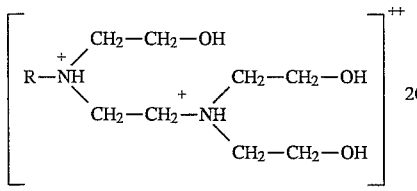

ammonium compound

U.S. Pat. No. 4,454,049 describes the use of water miscible organic solvents such as hexylene glycol and nonionic extenders including $C_{12}$-$C_{24}$ linear and branched noncyclic hydrocarbons, and esters of glycerol with $C_{12}$-$C_{24}$ fatty acids as viscosity controlling agents to prepare concentrated dispersions (at least 20% actives) of substantially water-insoluble cationic imidazolinium compounds. U.S. Pat. No. 4,724,089 discloses the use of the following cyclic amines to prepare highly concentrated dispersions.

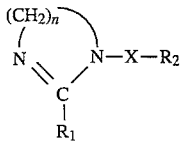

$R_1$, $R_2$ = Long Chain Alkyl or Alkenyl
$X = -R_3-T-\underset{\underset{O}{\|}}{C}-$
$R_3 = C_1-C_4$ alkyl
T = O or alkyl James and Ogden (Journal of the American Oil Chemist's Society 56 1979) describe that the viscosity of aqueous cationic dispersions is highly affected by the manufacturing variables such as the temperature of the dispersion, electrolyte content, and method of stirring. Not only the dimension and speed of the stirrer but also the stirring time and the size and construction of the mixing tank influence the fineness of the dispersion. They also point out that dispersions of low viscosity can be produced directly by homogenization.

However, of the many approaches tested by the present inventors, it was found that the incorporation of cyclic imidazolinium compounds not only significantly increased the concentratability of the fatty amido tertiary amine but, quite surprisingly, also significantly improved the softening efficacy of Varisoft 510.

Accordingly, it is an object of this invention to provide low viscosity, stable and flowable aqueous dispersions containing softening effective amount of fatty amido tertiary amine fabric softener.

Another object of the invention is to provide such low viscosity, stable and flowable aqueous with the fatty amido tertiary amine fabric softener in amounts of at least 10 percent by weight of the composition.

SUMMARY OF THE INVENTION

The above and other objects of the invention which will become more apparent from the following detailed description and examples, has been achieved by a stable, pourable, water dispersible aqueous liquid fabric softener composition which includes (A) a softening effective amount of an inorganic or organic acid salt of a finely divided fatty amido tertiary amine compound of formula (I):

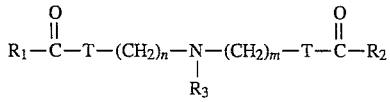

(I)

wherein $R_1$ and $R_2$, independently, represent $C_{12}$ to $C_{20}$ alkyl or alkenyl; $R_3$ represents $(CH_2CH_2O)_pH$, $CH_3$ or H; T represents O or NH; n and m are each, independently, a number of 1 to 5; and p is a number of from 1 to 10; (B) a viscosity controlling and softening improving effective amount of a cyclic imidazolinium compound of formula (II):

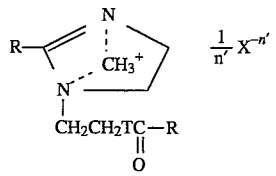

wherein each R represents $C_{12}$ to $C_{20}$ alkyl or alkenyl;

T represents O or NH; and

X represents a counter-anion of valence n'; and (C) an aqueous solvent including an anti-gelling effective amount of electrolyte.

The present invention also provides a method of imparting softness to fabrics by contacting the fabrics with a softening effective amount of the invention fabric softener composition; generally and preferably, in the rinse cycle of an automatic laundry washing machine. The compositions may be diluted with water prior to adding the composition to the washing machine (e.g., the rinse cycle dispenser).

DETAILED DESCRIPTION AND PREFERRED EMBODIMENTS

The present invention was developed as part of an extensive research program to evaluate available fabric softening compounds which do not pose the risk of, or at least reduce the risk of, causing environmental damage associated with conventional cationic quat fabric softeners such as DMDSAC yet which offer equivalent or superior softening performance to DMDSAC and which are amenable for use in concentrated products. The latter requirement is important in view of the trend in the industry to sell concentrated products which require less packaging and lower shipping costs on a per unit or per usage basis and, therefore, can be characterized as environmentally and user friendly.

As a result of this extensive research it was found that the class of amidoamines, and particularly fatty amidotertiary amines and corresponding esters of the foregoing formula (I), and which are commercially available, for example, under the Varisoft trademark from Sherex Chemical Co., when provided in the form of its acid (protonated) complex, met the objectives of high efficacy softening performance and environmental acceptability.

Although not wishing to be bound by any particular theory of operation it is believed that the good softening performance is due to the excellent inherent dispersibility of the finely divided amidoamine softener when the compound is protonated as its acid complex. Such excellent inherent dispersibility is believed to result from the presence of the diamido amine hydrophilic group, which may be further enhanced by a moderate level of ethoxylation (e.g., when $R_3$ represents $(CH_2CH_2O)_pH$). On the other hand, the presence of the two long chain hydrocarbon groups ($C_8$-$C_{20}$ alkyl or alkenyl) contribute to effective fabric softening.

However, the concentratability of the fatty tertiary amido amine fabric softeners of formula (I) was found to be limited to no more than about 11% by weight before gelation occurs or otherwise unacceptably high viscosity results. It is presumed that this phenomenon is the result of the crystallinity of fatty tertiary amine, that is, the formation of a liquid crystalline phase. In general, the viscosity increase in concentrated samples and over time is believed to be associated with the formation of multilayered vesicle structures which trap more and more water and thus, in turn, the composition exhibits an increase in viscosity. In other words, the phase volume of the composition increases with increasing softener concentration and time while the continuous (aqueous) phase gradually decreases with time.

Although not wishing to be bound by any theory it is believed that the imidazolinium compounds of formula (II) reduce the crystallinity of the fatty tertiary amido amine of formula (I) (especially the compounds where R=alkyl, e.g., hydrogenated tallow, as in Varisoft 510). In addition, the improvement in softening performance, as shown by the following examples, is presumed to be due to the site provided by the imidazole group for hydrogen bonding with the fabric cellulose, although it is not clear that this hydrogen bonding would, by itself, be responsible for the synergistic improvement in softening performance. In contrast, it has been observed that Varisoft 512 (soft tallow tertiary amine) is also capable of reducing the crystallinity of, and concentratability of Varisoft 510 (hydrogenated (hard) tallow tertiary amine) but it does not improve softening performance. Again, this poor softening efficacy is probably due to the lack of a hydrogen binding site on the protonated compound (i.e., the election pair or nitrogen is "used up" by protonation).

While it has been known in the past that stability against phase separation of aqueous dispersions of finely divided substances, including fabric softening or other fabric treating agents, may be improved by incorporating certain dispersing aides, co-surfactants, emulsifiers, and the like, into the aqueous dispersions, the art has not provided any general guidelines or principles for determining which of the myriad possible candidate compounds would be able to provide the desired improvement in stability and reduction in viscosity, much less improvement in softening performance.

The present inventors have now found that the fatty amide or fatty ester derivative of the cyclic imidazolinium compound of the formula (II) when added to an aqueous dispersion of the fatty amide (or ester) tertiary amine compound fabric softener of the formula (I) will permit an increase in the amount of the fabric softener added to the aqueous dispersion without impairing pourability and stability of the dispersion, while at the same time often improving softening performance. Therefore, the mixture of the compounds of formulas (I) and (II) allow the compositions to be formulated as concentrates for subsequent dilution (if desired) at ratios as high as 8:1 or higher, while still remaining pourable in the concentrated form, but not unduly watery in the diluted form. These same concentrated formulas may, of course, be used without dilution but in smaller quantities to achieve superior softening performance.

Thus, the compositions of this invention are stable, aqueous, pourable, and water dispersible compositions which contain, a fabric softening effective amount of an inorganic or organic acid salt of fatty amido (or ester) tertiary amine of formula (I) and a viscosity reducing effective amount of fatty amide (or ester) cyclic imidazolinium compound of formula (II).

The fabric softening active compound is an amido tertiary amine of formula (I):

$$R_1-\overset{\overset{\displaystyle O}{\|}}{C}-T-(CH_2)_n-\overset{\overset{\displaystyle R_3}{|}}{N}-(CH_2)_m-T-\overset{\overset{\displaystyle O}{\|}}{C}-R_2 \qquad (I)$$

In the above formula $R_1$ and $R_2$ are each, independently, long chain alkyl or alkenyl groups having from 8 to 22 carbon atoms, preferably from 10 to 18 carbon atoms, such as, for example, octyl, octenyl, decyl, decenyl, dodecyl, dodecenyl, octadecyl, octadecenyl. Typically, $R_1$ and $R_2$, and more generally $R_1$—CO— and $R_2$—CO, will be derived from natural oils containing fatty acids or fatty acid mixtures, such as coconut oil, palm oil, tallow, rape oil, and fish oil. Chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture. When $R_2$ and/or $R_2$ are derived from or contain unsaturated (i.e., alkenyl) group, the compound is preferably hydrogenated to reduce or eliminate the unsaturation as in the preferred Varisoft 510.

$R_3$ represents $(CH_2CH_2O)_pH$, $CH_3$ or H, or mixtures thereof may also be present. When $R_3$ represents the preferred $(CH_2CH_2O)_pH$ group, p is a positive number representing the average degree of ethoxylation, and is preferably from 1 to 10, especially 1.5 to 6, and most preferably from about 2 to 4, such as 2.5. n and m are each integers of from 1 to 5, preferably 2 to 4, especially 2. The compounds of formula (I) in which $R_3$ represents the preferred $(CH_2CH_2O)_pH$ group are broadly referred to herein as ethoxylated amidoamines (when T=NH) or ethoxylated ester amines (when T=O), and the term "hydroxyethyl" is also used to describe the $(CH_2CH_2O)_pH$ group.

Most especially preferred is the compound of formula (I) which is commercially available under the tradename Varisoft 510, available from Sherex Chemical Company, which is bis(hydrogenated tallow-amidoethyl)-hydroxyethyl amine of formula $$\left( (\text{H-tallow})-\overset{\overset{\displaystyle O}{\|}}{C}-NH-CH_2CH_2 \right)_2-N-(CH_2CH_2O)_{2.5}H.$$

In place of the Varisoft 510, or in combination therewith, the corresponding ester-hydrogenated tallow derivative, or equivalent, e.g., $$(\text{H-Tallow})-COO-(CH_2)_n-\underset{\underset{\displaystyle (CH_2CH_2O)_pH}{|}}{N}-(CH_2)_m-OOC-(\text{H-Tallow})$$

may be used.

In the non-neutralized (non-protonated) form the fatty amide or fatty ester tertiary amine compounds are hardly or not at all dispersible in water. Therefore, in the present invention, the amine function of the amidoamine or ester amine compound is at least partially neutralized by a proton contributed by a dissociable acid, which may be inorganic, e.g., HCl, $H_2SO_4$, $HNO_3$, etc. or organic, e.g., acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid used will depend on the "strength" of the acid; strong acids such as HCl, and $H_2SO_4$ completely dissociate in water and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least an 0.5:1 molar ratio, and up to about a 1:1 molar ratio of the acid to the total amount of fabric softener fatty amide or ester tertiary amine. For the organic carboxylic acids, however, it is preferred to use a molar excess of the neutralizing acid. Molar ratios of organic carboxylic acid to the compound of formula (I) up to about 6:1, for example from 1.5:1 to 6:1, such as 2:1, 3:1 or 4:1, have been found advantageous in terms of stability and/or softening performance. The use of glycolic acid in molar excess is especially preferred.

However, it has also been found that partially neutralized ethoxylated fatty amide or fatty ester tertiary amines are highly stable. Therefore, in some cases molar ratios of acid (as HCl) to ethoxylated amine (or ester) of formula (I) of from 0.5:1 to about 0.95:1, such as 0.6:1 and 0.7:1, can be advantageously used. For the mineral acids, such as HCl, molar ratios above 1:1 should generally be avoided since, otherwise, a gel may form.

In another aspect of the invention, and based on structural similarities, the fatty tertiary amido amine may be replaced, in whole, or in part, with a quaternized ammonium diester compound of the following formula (III)

$$\left[ R_1-\overset{\overset{\displaystyle O}{\|}}{C}-O\left(CH_2\right)_n\overset{\overset{\displaystyle R_3}{|}}{\underset{\underset{\displaystyle R_4}{|}}{N^+}}\left(CH_2\right)_m-O-\overset{\overset{\displaystyle O}{\|}}{C}-R_2 \right] \cdot \frac{1}{n} X^{-n'} \qquad \text{(III)}$$

wherein $R_1$, $R_2$, $R_3$, n, and m have the same definitions as in formula (I), $R_4$ represents a lower alkyl of from 1 to 4 carbon atoms, and preferably methyl; and X represents a counter ion of valence n'. For example, the diester quat of formula (III) may be a compound of the formula $$R_1-\overset{\overset{\displaystyle O}{\|}}{C}-O-CH_2-CH_2-\overset{\overset{\displaystyle CH_2CH_2OH}{|}}{\underset{\underset{\displaystyle CH_3}{|}}{N^+}}-CH_2CH_2-O-\overset{\overset{\displaystyle O}{\|}}{C}-R_2.CH_3SO_4^-$$

where $R_1$ and $R_2$ may be, for example, derived from hard or soft tallow, coco, stearyl, oleyl, and the like.

The compounds of formula (II) are di-long chain amide or di-long chain ester derivatives of cyclic imidazolinium compounds:

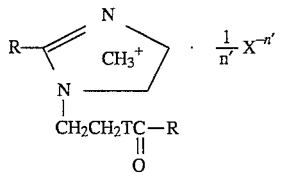

(II)

wherein R represents $C_{12}$ to $C_{20}$ alkyl or alkenyl;

T represents NH or O; and

X represents a counteranion of valence n' such as alkyl sulfate, e.g., methosulfate, ethosulfate; halide, e.g., chloride, bromide; sulfate; nitrate; acetate; oleate; etc. The methosulfate salt is preferred.

In the compounds of formula (II) the dotted lines between the nitrogen atoms and the methyl group indicate that the methyl group may be associated with either nitrogen atom. These compounds may, alternatively, be represented by the formula (II'):

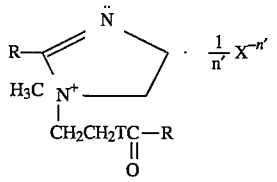

(II')

where R and T and X are as previously defined.

A representative and preferred example of the compounds of formula (II) is the di-tallow amido imidazolinium compound available from Akzo Chemical Co. as Armosoft 420-90 as the methosulfate salt. The tallow groups may be hydrogenated or non-hydrogenated. It is believed that the tallow groups in Armosoft 420-90 are soft tallow, i.e., non-hydrogenated.

When the compounds of formula (I) and formula (II) are used in admixture, preferably at ratios of about 10:1 to about 0.5:1, more preferably from 8:1 to 1:1, especially 6:1 to 1:1, both softening performance and stability and pourability are improved. That is, notwithstanding the poor softening performance of the imidazolinium compounds (II) when used alone, when used in combination with the soft tallow amido (or ester) amine compound a surprisingly substantial improvement in softening performance is observed.

As will be seen from the following examples such substantial and, in fact, synergistic improvement in softening performance is primarily observed when the compounds of formula (I) and formula (II) are used at approximately equimolar less, even at well below 10 percent by weight total amount of active softening compounds. Accordingly, in one particular aspect of the invention, fabric softening compositions which are stable, pourable, and water dispersible aqueous dispersions are provided which contain from at least 2 percent, preferably at least 4 percent, more preferably at least 10 percent, especially preferably at least 11 or 12 percent by weight and up to about 60 percent, preferably up to about 35 percent, more preferably up to about 30 percent by weight of a mixture of (A) an organic or inorganic acid salt of a finely divided fabric softening compound of formula (I):

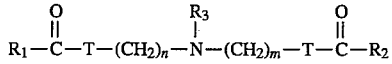

(I)

and (B) a cyclic imidazolinium compound of formula (II)

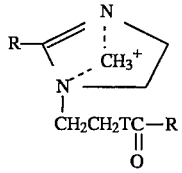

(II)

where R, $R_1$, $R_2$, $R_3$, T, m and n are defined above at a weight ratio of (A):(B) of from about 0.7:1 to about 1:0.7, and (C) an aqueous solvent. Such compositions provide softening performance greater than the performance which would be expected based on the performance of equivalent amounts of the compound of formula (I) alone or the compound of formula (II) alone.

Preferably, the total amounts of components (A) and (B) is from about 3 to about 30 wt. percent, more preferably from about 5 to about 25 wt. %, and the ratio, by weight, of (A):(B) is from about 0.9:1 to 1:0.9, and especially, about 1:1.

The compositions of this invention are provided as aqueous dispersions in which the fabric softener compound of formula (I) and formula (II) are present in finely divided form stably dispersed in the aqueous phase. Generally, particle sizes of the dispersed particles of less than 25 microns (μm), preferably less than 20 μm, especially preferably of no more than 10 μm, on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 μm, preferably at least about 0.05 μm. A preferred particle size range of the dispersed softener ingredients is from about 0.1 to about 8 μm.

However, one of the advantageous features of the compositions of this invention is that it is not necessary to subject the composition to high shear conditions, such as by high pressure homogenization. Simple mixing of the ingredients in water with a low shear mixer provides stable dispersions of finely divided particles.

The aqueous phase of the dispersion is primarily water, usually deionized or distilled water, with small amounts of co-solvent usually being present for adjustment of viscosity. Typically, as the co-solvent lower mono- and poly-hydroxy alcohols and glycols will be used, generally in amounts up to about 8% by weight of the composition. The preferred alcohols and glycols are those having from 2 to 4 carbon atoms, such as, for example, ethanol, propanol, isopropanol, and propylene glycol or ethylene glycol. Isopropyl alcohol (2-propanol) is especially preferred.

The compositions of this invention will generally include an electrolyte to reduce dispersion viscosity, especially for amounts of the compound of formula (I) above about 11 weight percent. Generally, any of the alkali metal or alkaline earth metal salts of the mineral acids can be used as electrolyte. In view of availability, solubility and low toxicity NaCl, $CaCl_2$, and KCl are preferred, and $CaCl_2$ is especially preferred. The amount of the electrolyte will be selected to assure that the composition does not form a gel. Generally, amounts of electrolyte salt of from about 0.05 to 2.0 wt. %, preferably 0.1 to 1.0 wt %, especially preferably 0.25 to 0.60 wt. %, will effectively prevent gelation from occurring.

As is generally understood the role of the electrolyte to inhibit gelation can be explained based on the assumption that the invention dispersions of the cationic softening compounds have a vesicular structure. The spacing of the multilayered vesicles in the liquid crystalline phases varies with the electrolyte concentration since it depends on the repulsion between the head groups in adjacent layers. The amount of the enclosed water tends to be reduced at high salt concentrations, causing a lowering of the disperse phase volume and the viscosity. However, if one exceeds a critical concentration of the electrolyte, this may lead to a destabilization of the emulsions by flocculation or coalescence. The phenomenon of flocculation or coalescence can be explained by considering the electrostatic stabilization of colloidal dispersions. Attractive as well as repulsive forces act on the individual particles of a dispersion. The repulsive forces increase exponentially as the particles approach each other, such as when the concentration of the dispersion increases, and they become very strong when the electrical double layers (the counterions in the dispersion medium give rise to the electrical double layers that surround the colloidal particles) that envelope each particle overlap. The thickness of the electrical double layers is very sensitive to the ionic strength of the dispersion medium. Increasing the ionic strength significantly diminishes the thickness of the double layer. The repulsive forces then become of insufficient magnitude and are no longer able to overcome the attractive van der Waals forces which may lead to dispersion flocculation or coagulation.

Another optional ingredient in the invention compositions is a rheology modifier to help reduce or eliminate variations in the aqueous dispersion viscosity over time. It should be understood, however, that so long as the viscosity does not increase to an unacceptably high level over the expected life of the product (including transportation from the manufacturing plant to the market place, shelf-life in the market place, and duration of consumption by the end user). For example, the viscosity after, for instance, 8 to 10 weeks, should preferably not exceed about 3000 cps (at 25° C.), especially preferably the viscosity should not exceed about 1000 cps (at 25° C.) over the expected lifetime of the product.

Therefore, if there is concern about undesirable increase in product viscosity, or if changes in viscosity over time are considered undesirable, a rheology modifier can be added to the composition. Examples of rheology modifiers are well known in the art and may be chosen from, for example, polymeric rheology modifiers and inorganic rheology modifiers. Examples of the former type include polyquaternium compounds, such as Polyquaternium-24 (a hydrophobically modified polymeric quaternary ammonium salt hydroxyethyl-cellulose, available from Amercho, Inc.); cationic polymers such as copolymers of acrylamide and quaternary ammonium acarylate; the Carbopols, and the like. Examples of inorganic rheology modifiers include, for example, alumina. Generally, only minor amounts, up to about 1.0%, preferably up to about 0.8%, such as, for example, 0.01 to 0.60 percent, by weight, provide acceptable viscosity levels over time.

Another additive which has been found to be useful as a rheology modifier is citric acid, generally in amounts of from about 0.05 to 1.0 wt. %, preferably from about 0.1 to 0.6 weight percent.

Other optional components commonly used in fabric softening compositions may be added in minor amounts to enhance either the appearance or performance properties of the liquid fabric softener compositions of this invention. Typical components of this type include, but are not limited to colorants, e.g., dyes or pigments, bluing agents, preservatives, germicides, and perfumes.

The subject liquid fabric softener compositions may be prepared by adding the active ingredients, usually as a melt, to the heated aqueous phase to which the acid component has been pre-mixed, under mixing. Low-shear mixing is generally sufficient to adequately and uniformly disperse the active ingredients in and throughout the aqueous phase. Further particle size reduction can be obtained by subjecting the composition to further treatment such as in a colloid mill or by high pressure homogenization, however, as previously noted, no significant improvement in softening performance has been associated with such particle size reduction.

The final product, whether in concentrated or diluted form must be easily pourable by the end user. Generally, therefore, final product viscosity (for a freshly prepared sample) should not exceed about 2000 centipoise, preferably not more than 1000 centipoise, but should not be too low, for example not less than about 50 centipoise. The preferred viscosity in the diluted or ready-to-use product is in the range of 120 to 200 centipoise. As used herein viscosity is measured at 25° C. (22°–26° C.) using a Brookfield RVTD Digital Viscometer with Spindle #4 at 20 rpm (unless otherwise stated).

For a concentrated product, the compositions may be formulated to be diluted by a factor of generally 4:1 or more, preferably up to about 8:1 or even 9 to 10:1. For the preferred hard-tallow ethoxylated amidoamine softener, Varisoft 510, concentrated products with up to about 12 weight percent of softener may be prepared and will remain stable against phase separation or suspended particle agglomeration for extended periods of time. Such concentrated products with 12 wt. % Varisoft 510 may be diluted up to about 4:1 and still provide equivalent softness at the same use level (e.g., about 110 ml for standard European washing machines) as a softener product containing 5 weight percent of ditallow (or distearyl) dimethyl ammonium chloride. For the more concentrated products, the more soluble soft-tallow ethoxylated amidoamine, e.g., Varisoft 512, should be used in place of part or all of the hard-tallow compound. After dilution, or for a ready-to-use product, the composition will normally contain sufficient softener to be effective when added to the rinse water in an amount of about one-eighth to three-quarters of a cup (1 to 6 ounces) providing about 25 ppm to about 90 ppm of softener in the rinse water.

In the above description and in the following examples and claims all parts and percentages are given on a weight basis unless otherwise stated.

EXAMPLE 1

This example demonstrates the ability of the imidazolinium compound (b) to control the viscosity of aqueous dispersions of compound (a) with total amounts of the active softening compounds (a) and (b) in excess of 10 weight percent.

The compositions shown in Table 1 were prepared as described below.

TABLE 1

| Composition | #1 (wt %) | #2 (wt %) | #3 (wt %) | #4 (wt %) | #5 (wt %) | #6 (wt %) | #7 (wt %) |
|---|---|---|---|---|---|---|---|
| Varisoft-510[1)] | 11 | 12 | 20 | 10 | 10 | 12.5 | 10 |
| Armeen DMHTD H-tallow dimethyl amine | 1.65 | 1.8 | — | — | — | — | 0.5 |
| Armosoft 420-90[2)] | — | — | — | 10 | 10 | 12.5 | 10 |
| HCl | 0.79 | 0.86 | 1.46 | 0.72 | 0.72 | 0.9 | 0.72 |
| 2-Propanol | 4.4 | 4.0 | 4 | 7.7 | 4 | 5 | 4 |
| $CaCl_2$ | — | — | 0.46 | 0.47 | 0.37 | 0.45 | 0.3 |

TABLE 1-continued

| Composition | #1 (wt %) | #2 (wt %) | #3 (wt %) | #4 (wt %) | #5 (wt %) | #6 (wt %) | #7 (wt %) |
|---|---|---|---|---|---|---|---|
| $H_2O$ | balance to 100 | balance to 100 | balance to 100 | balance to 100 | balance to 100 | balance to 100 | balance to 100 |

[1]bis(hydrogenated tallow amido ethyl) hydroxyethyl (2.5EO) amine (from Sherex Chemical Co.).
[2]4,5-dihydro-1-methyl-2-nortallow alkyl-2(2-tallow amido ethyl) imidazolinium methyl sulfate (from Akzo Chemical)

The dispersion (1–3, and 5–7,) were prepared by adding the aqueous solution of HCl at 70° C. into the molten oily phase while stirring. $CaCl_2$ solution was added into the hot dispersions which were either rapidly cooled to room temperature or allowed to cool to room temperature slowly with stirring. During cooling, a few drops of Dow Corning 1430 antifoam was added. A stable low viscosity (<700 cP at room temperature) dispersion of Varisoft-510 is obtained only up to 11% level (Table 1).

Dispersion 4 was prepared by adding molten mixture of Varisoft-510, Armosoft 420-90 and propanol to stirred deionized water containing HCl at 55°–70° C. The results (Table 2) show that the sequence of addition of the ingredients is important to obtain low viscosity flowable dispersions of Varisoft-510 and Armosoft 420-90.

The viscosity and other properties are shown in the following Table 2.

TABLE 2

| Physical Properties | Composition #1 | #2 | #3 | #4 | #5 | #6 | #7 |
|---|---|---|---|---|---|---|---|
| Comments | Softening Efficacy <5EQ at 5% level | Thick Gel | Thick Gel; Softening Efficacy <2EQ at 5% level | Thick Gel | Softening Efficacy >6EQ at 5% level | — | Softening Efficacy >6EQ at 5% level |
| pH | 1.83 | 1.6 | — | — | 1.29 | 0.98 | 1.46 |
| Viscosity, cP 20 rpm | spindle 4 | spindle 6 | spindle 6 | | spindle 4 | spindle 4 | spindle 4 |
| Initial | 270 | 10,150 | 12,600 | — | 60 | 140 | 60 |
| Day 1 | — | | | — | 100 | 220 | 140 |
| Week 1 | — | | | — | 120 | 360 | 270 |
| Week 2 | — | | | | 150 | 470 | 380 |
| Week 3 | 240 | | | | 160 | 560 | 520 |

Above 11% level, the viscosity increases exponentially with the concentration. At 11% level the initial viscosity (Brookfield RVTD, spindle 4, 20 rpm) of the dispersion (#1) at room temperature is only 270 cP. In contrast, the viscosity of Varisoft-510 dispersion at 12% level is 10,150 cP. This dispersion and dispersion #3 are essentially (relatively speaking) non-flowable gels. Compositions 5–7 show that stable (no phase separation) and low viscosity dispersions of Varisoft-500 containing Armosoft 420-90 can be prepared up to 25% active level in the presence or absence of an emulsifier, such as Armeen DMHTD (H-tallow dimethyl amine (Akzo Chemical Company). Softening efficacy of the dispersions at 5% level was compared with ditallow dimethyl ammonium chloride. The softening efficacy of these dispersions (5–7, Table 2) at 5% solid level is greater than 6EQ. Product activity of 1EQ is the softening obtained by 1% dispersion of ditallow dimethyl ammonium chloride. The dispersion #3, at 5% use level under similar conditions exhibited a product activity of <2EQ. Therefore, Armosoft 420-90 not only significantly increases the concentratability of the systems but also improves the softening efficacy of concentrated (≧10%) dispersions of Varisoft-510.

EXAMPLE 2

This example further demonstrates the synergistic interaction between components (a) and (b).

The compositions shown in Table 3 were prepared in the same manner used to prepare compositions 5–7 of Table 1 in Example 1, namely, the aqueous solution added to the oil phase. The results are shown in Table 4.

TABLE 3

| Composition | #8 (wt %) | #9 (wt %) | #10 (wt %) | #11 (wt %) | #12 (wt %) | #13 (wt %) |
|---|---|---|---|---|---|---|
| Varisoft-510 | — | 20 | 10 | — | 12.5 | 2.5 |
| Armosoft 420-90 | 20 | — | 10 | 5.0 | 12.5 | 2.5 |
| HCl | — | 1.46 | 0.72 | — | 0.9 | 0.18 |
| Dow 1430 Defoamer | 0.04 | 0.04 | 0.04 | 0.03 | 0.04 | 0.044 |
| $CaCl_2$ | 0.27 | 0.46 | 0.31 | — | 0.45 | — |
| 2-Propanol | — | 4.0 | 4.0 | — | 5 | 2.0 |
| $H_2O$ | balance to 100 | balance to 100 | balance to 100 | balance to 100 | balance to 100 | balance to 100 |

TABLE 4

| Physical Properties Composition | #8 | #9 | #10 | #11 | #12 | #13 |
|---|---|---|---|---|---|---|
| Comments | Softening Efficacy <2EQ at 5% level | Softening Efficacy <2EQ at 5% level | Softening Efficacy 6–7EQ at 5% level | Softening Efficacy <2EQ at 5% level | Softening Efficacy 7EQ at 5% level | Softening Efficacy 10EQ at this level |
| Average Particle Size (μm) | 11.69 | — | 1.12 | 16.39 | 1.14 | 0.83 |
| pH | 5.01 | 0.73 | 1.01 | 4.65 | 0.98 | 2.09 |
| Viscosity, cP 20 rpm | spindle 4 | spindle 6 | spindle 4 | spindle 4 | spindle 4 | spindle 4 |
| Initial | 120 | 12600 | 90 | 80 | 140 | 30 |
| Day 2 | 190 | 14800 | 150 | — | | |
| Week 1 | 420 | — | 200 | — | 360 | — |
| Week 2 | 560 | — | 280 | — | 470 | — |

The softening efficacy of composition #12 is 7EQ at 5% use level or (theoretically, it is 35 EQ for the 25% system). The softening corresponding to 5% level of ditallow dimethylammonium chloride (DTDMAC) is referred as 5EQ and at double dosage level (corresponding to 10% level of DTDMAC) is referred to as 10 EQ. If one plots a graph of softening versus the dosage amount of ditallow dimethylammonium chloride (a standard used for the softening evaluation), the softening increases linearly with the dosage of DTDMAC up to about 9–10% and then it levels off. This means, that for a dispersion of ditallow dimethylammonium chloride (say 5%) comparing the softening efficacy at 15% and 12% dosage levels, one cannot make a distinction in the softening performance. The softening efficacy of 7EQ assigned to composition #12 on the basis of a test in which the 25% dispersion was compared with a 5% dispersion of DTDMAC. If "y" grams of the 5% DTDMAC product were used in the test to get a softening efficacy of 5EQ, then ("y"×7/5) grams would be used to get 7 EQ softening efficacy. The amount of 25% dispersion employed was equal to [5/25("y")] grams. At this level (5%), the softening efficacy of composition #12 is equal to 7EQ. So in general the EQ ratings are obtained at low concentration levels.

As shown in Table 4 Armosoft 420-90 when used alone at 20% level (#8) exhibits a softening activity of less than 2EQ (when diluted to a 5% level or when prepared directly at the 5% level(#1)). Similarly, the composition containing 20 wt % Varisoft-510 alone (#9), in addition to its very high viscosity and gel-like property, also exhibited a softening performance, at the 5% level, of less than 2EQ.

In contrast, Table 4 (compositions 10, 12, 13) shows that product activity of 6–10 EQ at 5% use level is obtained for blends of Varisoft-510 and Armosoft 420-90. Softening efficacy of the dispersions at 5% level was compared with ditallow dimethyl ammonium chloride. These softening performance values correlate to a value of 35 EQ for the undiluted composition #12 (based on the assumption of linear effect for the amount of softening agent and softening performance).

EXAMPLE 3

This example demonstrates the differences between the compositions according to this invention and compositions as generally disclosed in the copending application Ser. No. 07/995,102.

The compositions shown in the following Table 5 were prepared as described below.

TABLE 5

| Composition | #14 (wt %) | #15 (wt %) | #16 (wt %) | #17 (wt %) | #18 (wt %) | #19 (wt %) |
|---|---|---|---|---|---|---|
| Varisoft-510 | 20 | 20 | 20 | 10 | 10 | — |
| Varisoft-512[1)] | 1 | 1 | — | 0.5 | — | 20 |
| Armeen DMHTD | — | — | 3 | — | 1.5 | 3 |
| HCl | 1.46 | 1.46 | 1.46 | 0.72 | 0.72 | 1.46 |
| Dodecanol | — | 4 | — | — | — | — |
| 2-Propanol | 4 | 4 | 25 | — | 4 | 4 |
| $CaCl_2$ | 0.8 | 0.8 | 0.6 | 0.4 | 0.42 | 0.8 |
| $H_2O$ | balance to 100 | balance to 100 | balance to 100 | balance to 100 | balance to 100 | balance to 100 |
| Physical Properties | | | | | | |
| Comments | Thick Gel | — | Homogenization resulted in paste[3)] | Softening[2)] Rank ≦ 5EQ | Thick Gel | Softening[2)] Rank ≦ 5EQ |

TABLE 5-continued

| Composition | #14 (wt %) | #15 (wt %) | #16 (wt %) | #17 (wt %) | #18 (wt %) | #19 (wt %) |
|---|---|---|---|---|---|---|
| pH | — | ~2 | ~1.5 | 1.36 | — | 2.69 |
| Viscosity, cP 20 rpm, spindle 4 | | | | | | |
| Initial | — | 2360 | — | 110 | — | 1200 |
| | — | — | — | 1800 (24 h) | — | 1150 (2 days) |

[1]bis(tallow(soft)amido ethyl) hydroxyethylamine
[2]Softening performance tests were performed at 5% actives level on samples that were 2–3 days old.
[3]The freshly prepared dispersion was easily flowable but, after cooling to ambient temperature formed a thick non-flowable paste.

The dispersions 14–19 were prepared at 250 g scale by adding molten mixture of Varisoft-510/512, Armeen DMHTD (H-tallow dimethyl amine), dodecanol, and propanol to stirred deionized water containing HCl at 55°–70° C. Stirring was achieved by a Premier mixer which was hooked to a variac for control of the motor speed. Typically the melt was added slowly in increments of 25% of the total required. Each increment of the melt was allowed to thoroughly mix. When the dispersion thickened, a minimum amount of $CaCl_2$ solution (25%) was added to thin out the dispersion. The process of addition of the melt was continued until all the oil was added and thoroughly mixed. In almost all dispersions Dow Corning 1430 antifoam (two to three drops) was also employed and was added after the addition of all the components. The stirring of the dispersions were continued until they cooled to room temperature. The results in Table 5, Run No. 17 show that while the mixture of the hard (Varisoft 510) and soft (Varisoft 512) tallow amidoamine softeners (#17) can be formulated at above 10 wt % level (i.e., 10.5%) without becoming excessively viscous, softening performance is still relatively low. Varisoft 512 alone (#19) even at 20% level has a softening efficacy of less than 5EQ. The compositions 14, 16, 18 (oil phase added to aqueous phase) resulted in thick non-flowable gels.

EXAMPLE 4

The following compositions, shown in Tables 6 and 7 were prepared by adding the aqueous solution of HCl and propanol at 70° C. to the molten oily phase (fabric softener/emulsifier). $CaCl_2$ solution was added into the hot dispersions which were subsequently allowed to cool at room temperature with stirring. During cooling, a few drops of Dow Corning 1430 antifoam were added.

From Run No. 22 and Run No. 23 of Table 6 it is seen that at above 11% Varisoft 510 the addition of an emulsifier of the type shown in Ser. No. 07/995,102 even with propanol or electrolyte cannot prevent the compositions from becoming excessively viscous or forming a gel.

TABLE 6

| Composition | #20 (wt %) | #21 (wt %) | #22 (wt %) | #23 (wt %) |
|---|---|---|---|---|
| Varisoft-510 | 10 | 11 | 12 | 15 |
| Armeen DMHTD | 1.5 | 1.65 | 1.8 | 2.25 |
| HCl | 0.72 | 0.79 | 0.86 | 0.72 |
| 2-Propanol | 4 | 4.4 | 4.0 | — |
| $CaCl_2$ | — | — | — | 0.35 |
| $H_2O$ | balance | balance | balance | balance |

TABLE 6-continued

| Composition | #20 (wt %) | #21 (wt %) | #22 (wt %) | #23 (wt %) |
|---|---|---|---|---|
| | to 100 | to 100 | to 100 | to 100 |
| Physical Properties | | | | |
| Comments | — | Softening Rank[1] <5EQ | — | Thick Gel |
| pH | 1.95 | 1.83 | 1.6 | 1.36 |
| Viscosity, cP 20 rpm spindle 4 | | | | |
| Initial | 140 | 270 | 10150 | — |
| 2 Week | 170 | — | — | — |
| 3 Week | 190 | 240 (26 days) | — | — |
| 4 Week | 210 | — | — | — |

[1]Softening at 5% level of actives.

TABLE 7

| Composition | #24 (wt %) | #25 (wt %) | #26 (wt %) | #27 (wt %) |
|---|---|---|---|---|
| Varisoft-510 | 10 | 10 | 10 | 10 |
| Armeen DMHTD | 1.5 | 1.5 | 1.5 | 1.5 |
| HCl | 0.72 | 0.72 | 0.72 | 0.72 |
| Dodecanol | 0 | 0.5 | 1.0 | 1.5 |
| 2-Propanol | 4.0 | 4.0 | 4.0 | 4.0 |
| $CaCl_2$ | — | — | — | — |
| $H_2O$ | balance to 100 | balance to 100 | balance to 100 | balance to 100 |
| Physical Properties | | | | |
| Comments | Softening Rank[1] 7.98 | Softening Rank[1] 8.62 | Softening Rank[1] 8.47 | Softening Rank[1] 8.40 |
| pH | 2.14 | 2.16 | 2.23 | 2.22 |
| Viscosity, cP 20 rpm, spindle 4 | | | | |
| Initial | 200 | 140 | 60 | 220 |
| 2 Week | 230 | 200 | 150 | 420 |

[1]Scoring Rank on a scale of 1 to 10 (softest) (measured at 5% actives level)

The addition of dodecanol is seen to improve softening performance although to a level of only about ≦5EQ. All of the compositions 24–27 were stable, free-flowing and pourable.

EXAMPLE 5

This example shows the results of adding different amounts of Armosoft 420-90 to Varisoft 510 at a fixed (10%)

level. In these examples the aqueous solution is added at 70% to the molten oil phase. The compositions and properties are shown in Table 8.

TABLE 8

| Composition | #28 (wt %) | #29 (wt %) | #30 (wt %) | #31 (wt %) |
|---|---|---|---|---|
| Varisoft-510 | 10 | 10 | 10 | 10 |
| Armeen DMHTD | 1.5 | 1.5 | 1.5 | 1.5 |
| HCl | 0.72 | 0.72 | 0.72 | 0.72 |
| Armosoft 420-90 | 0 | 2.5 | 5.0 | 10.0 |
| 2-Propanol | 4.0 | 4.0 | 4.0 | 4.0 |
| $CaCl_2$ | — | 0.22 | 0.43 | 0.74 |
| $H_2O$ | balance to 100 | balance to 100 | balance to 100 | balance to 100 |
| Physical Properties | | | | |
| Comments | Softening Rank[1)] | Softening Rank[1)] | Softening Rank[1)] | Softening Rank[1)] |
| | 8.25 | 7.49 | 8.11 | 8.60 |
| pH | 1.9 | 1.70 | 1.86 | 2.01 |
| Viscosity, cP 20 rpm, spindle 4 | | | | |
| Initial | 140 | 990 | 2670 | 190 |
| 2 Week | — | — | — | 3290 |
| 3 Week | 180 | 3600 (not pour-able) | — | 3730 (pour-able) |

[1)]Scoring on a scale of 1 to 10 (softest) (measured at 5% actives level)

EXAMPLE 6

The compositions shown in Table 9 were prepared by adding the aqueous solution (HCl citric acid) to the molten oily phase to test the effect of citric acid as an antigelling agent in aqueous composition containing 15% Varisoft 510 and 5.32% Armosoft 420-90 (except Run No. 32).

TABLE 9

| Composition | #32 (wt %) | #33 (wt %) | #34 (wt %) | #35 (wt %) | #36 (wt %) | #37 (wt %) |
|---|---|---|---|---|---|---|
| Varisoft-510 | 15 | 15 | 15 | 15 | 15 | 15 |
| Varisoft-512 | 1.26 | 1.36 | 1.36 | 1.36 | 1.36 | 1.36 |
| Armosoft 420-90 | — | 5.32 | 5.32 | 5.32 | 5.32 | 5.32 |
| Citric Acid | 0.5 | 0.5 | 0 | 0.1 | 0.2 | 0.3 |
| HCl | 0.87 | 0.88 | 0.88 | 0.88 | 0.88 | 0.88 |
| Dodecanol | 1.06 | 1.08 | 1.08 | 1.08 | 1.08 | 1.08 |
| 2-Propanol | 4 | 4 | 4 | 4 | 4 | 4 |
| $CaCl_2$ | 0.56 | 0.64 | 0.64 | 0.4 | 0.2 | 1.18 |
| $H_2O$ | balance to 100 | balance to 100 | balance to 100 | balance to 100 | balance to 100 | balance to 100 |
| Physical Properties | | | | | | |
| Comments | | flowable | | | | easily flowable |
| pH | — | — | 1.62 | 1.59 | 1.54 | 1.57 |
| Viscosity, cP 20 rpm, spindle 4 | | | | | | |
| Initial | 2170 | 1730 | 3320 | 2790 | 2390 | 1710 |
| 1 Week | 4020 | 2000 | 4440 | 3020 | 2360 | 1590 |

The use of citric acid proved to be helpful in order to obtain flowable dispersions. Citric acid considerably decreases the viscosity of a system from 4020 cP (control, no citric acid, composition 32) to 2000 cP (citric acid at a level of 0.5% composition, 33). At 0.3% level of citric acid an easily flowable dispersion is produced (No. 37).

EXAMPLE 7

This example further demonstrates that the compositions of this invention are effective as stable aqueous, free-flowing, pourable, softening compositions, even in the absence of emulsifiers, such as Armeen DMHTD. The composition shown in the following Table 10 were prepared. In composition No. 38, the oil phase was added to the aqueous solution. The reverse order was used in Nos. 39–43.

TABLE 10

| Composition | #38 Control (wt %) | #39 (wt %) | #40 (wt %) | #41 (wt %) | #42 (wt %) | #43 (wt %) |
|---|---|---|---|---|---|---|
| Varisoft-510 | 10 | 10 | 10 | 10 | 10 | 10 |
| Armeen DMHTD | — | — | 1.5 | — | 1.5 | — |
| Varisoft-512 | — | — | — | — | — | 10 |
| BP-7050[2) 3)] | — | — | 0.05 | 0.05 | — | — |
| Armosoft 420-90 | 10 | 10 | 10 | 10 | 10 | — |
| HCl | 0.72 | 0.72 | 0.72 | 0.72 | 0.72 | 1.08 |
| 2-Propanol | 7.7 | 4 | 4 | 4 | 4 | 4 |
| $CaCl_2$ | 0.47 | 0.37 | 0.65 | 0.24 | 0.71 | 0.38 |
| $H_2O$ | balance to 100 | balance to 100 | balance to 100 | balance to 100 | balance to 100 | balance to 100 |
| Physical Properties | | | | | | |
| Comments | Thick Gel Softening Rank[1)] 8.39 | Softening Rank[1)] 8.48 | Softening Rank[1)] 8.56 | Softening Rank[1)] 8.28 | Softening Rank[1)] 8.97 | Softening Rank [1)] 6.28 |
| pH | — | 1.29 | 2.64 | 1.20 | 2.54 | 1.80 |
| Viscosity, cP 20 rpm, spindle 4 | | | | | | |
| Initial | — | 60 | 420 | 40 | 740 | 30 |
| Day 1 | — | 100 | 890 | 70 | — | 30 |
| Week 1 | — | 120 | 1710 | 100 | 5180 | 40 |

[1)]Softening performance at 5% level measured on scale of 1 to 10 (softest)
[2)]Poly(Acrylamide/quaternary ammonium acrylate) (50%) in solvent refined mineral base oil, from BP Chemicals Ltd., United Kingdom
[3)]Added last, during cooling Although Armeen helps in providing slightly higher softening performance of Varisoft-510 dispersions, it is problematic in terms of obtaining low viscosity, easily flowable concentrated dispersions. Comparison of composition 39 (no Armeen DMHTD) with 42 (with Armeen DMHTD) indicates that a low viscosity dispersion of Varisoft-510 and Armosoft 420-90 is obtained at 20% active level in the absence of Armeen DMHTD. Table 10 also shows that the use of cationic polymer (BP-7050) (40, 41) as a viscosity controlling agent in the dispersions of Varisoft-510 is effective to reduce viscosity. Composition 40 (with BP-7050, and Armeen DMHTD) has a one week viscosity of only 1710 cP as compared to 5180 cP viscosity for composition 42 (with Armeen DMHTD, and without BP-7050). Comparative softening evaluation of compositions 39–43 (at 5% solid level, considering them to be 20% active; one day old samples) is shown in Table 10. This composition shows that use of Armeen DMHTD as an emulsifier does help in obtaining higher softening performance (composition 42 with Armeen DMHTD versus 39 without Armeen DMHTD). Polymer BP-7050 slightly lowered the softening performance of Varisoft-510/Armosoft 420-90 dispersions but is still useful as a viscosity controlling agent.

EXAMPLE 8

This example further demonstrates the synergism in terms of softening performance at low levels of Varisoft 510 and Armosoft 420-90. The compositions shown in Table 11 were prepared as follows:

Compositions 44–48 were prepared as previously described by adding the aqueous solution to the molten oily phase; for compositions 45 and 46 the water temperature was 40° C., in compositions 44 and 47–48 it was 70° C.

Composition 49 was prepared by adding the oil phase to the aqueous solution.

TABLE 11

| Composition | #44 (wt %) | #45 (wt %) | #46 (wt %) | #47 (wt %) | #48 (wt %) | #49 (wt %) |
|---|---|---|---|---|---|---|
| Varisoft-510 | 5 | | — | 2.5 | 5 | 3.5 |
| Varisoft-512 | 0 | 0 | 0 | 0 | 0.5 | 0.5 |
| Armeen DMHTD | 0.75 | | | | 0 | 0 |
| Armosoft 420-90 | — | 5.0 | 5.0 | 2.5 | 0 | 0 |
| HCl | 0.36 | * | — | 0.18 | 0.36 | 0.25 |
| Dow 1430 Defoamer | 0.02 | 0.03 | 0.03 | 0.044 | 0.037 | 0 |
| 2-Propanol | 2.0 | — | — | 2.0 | 2.0 | 0 |
| $H_2O$ | balance to 100 | balance to 100 | balance to 100 | balance to 100 | balance to 100 | balance to 100 |

TABLE 11-continued

| Composition | #44 (wt %) | #45 (wt %) | #46 (wt %) | #47 (wt %) | #48 (wt %) | #49 (wt %) |
|---|---|---|---|---|---|---|
| Physical Properties | | | | | | |
| Comments | Softening Efficacy 4–5EQ range observed | Homogenized; Softening <2EQ | Softening Efficacy <2EQ at 5% level | Softening Efficacy 10EQ at this level | Softening Efficacy <6EQ at this level | Softening Efficacy 5EQ at this level |
| Average Particle Size (μm) | — | — | 16.39 | 0.83 | — | 1.89 |
| pH | 2.38 | 2.13 | 4.65 | 2.09 | 1.88 | 2.14 |
| Viscosity, cP 20 rpm | spindle 4 | | spindle 4 | spindle 4 | spindle 4 | spindle 4 |
| Initial | 60 | | 80 | 30 | 10 | 10 |

EXAMPLE 9

The following compositions shown in Table 12 were prepared as previously described (aqueous solution added at 70° C. to molten oil phase). The physical properties are shown in Table 13.

TABLE 12

| Composition | #21 (wt %) | #9 (wt %) | #52 (wt %) | #53 (wt %) | #12 (wt %) | #37 (wt %) | #56 (wt %) | #57 (wt %) | #58 (wt %) |
|---|---|---|---|---|---|---|---|---|---|
| Varisoft-510 | 11 | 20 | 10 | 10 | 12.5 | 15 | — | — | — |
| Armeen DMHTD H-tallow dimethyl amine | 1.65 | — | — | 0.5 | — | | — | — | 3.0 |
| Varisoft-512 | | | | | | 1.36 | — | 20 | 20 |
| Armosoft 420-90 | — | — | 10 | 10 | 12.5 | 5.32 | 20 | — | — |
| Citric Acid | | | | | | 0.3 | — | — | — |
| HCl | 0.79 | 1.46 | 0.72 | 0.72 | 0.9 | 0.88 | — | 1.6 | 1.46 |
| Dodecanol | | | | | | 1.08 | — | — | — |
| 2-Propanol | 4.4 | 4 | 4 | 4 | 5 | 4 | — | 4 | 4 |
| $CaCl_2$ | — | 0.46 | 0.37 | 0.3 | 0.45 | 1.18 | 0.27 | 0.2 | 0.169 |
| $H_2$) | balance to 100 | balance to 100 | balance to 100 | balance to 100 | balance to 100 | balance to 100 | balance to 100 | balance to 100 | balance to 100 |

TABLE 13

| Physical Properties | Composition | | | | | | | | |
|---|---|---|---|---|---|---|---|---|---|
| | #21 | #9 | #52 | #53 | #12 | #37 | #56 | #57 | #58 |
| Comments | Softening Efficacy <5EQ at 5% level | Thick Gel Softening Efficacy <2EQ at 5% level | Softening Efficacy >6EQ at 5% level | Softening Efficacy >6EQ at 5% level | Softening Efficacy 7EQ at 5% level | Softening Efficacy >5EQ at 5% level | Softening Efficacy <2EQ at 5% level | Softening Efficacy <4EQ at 5% level | Softening Efficacy <4EQ at 5% level |
| Average Particle Size (μm) | 4.9 | — | 1.12 | 1.47 | 1.14 | 4 | 11.7 | | |
| pH | 1.83 | 0.73 | 1.29 | 1.46 | 1.0–1.1 | 1.57 | 5.01 | 1.00 | 1.55 |
| Viscosity, cp 20 rpm | spindle 4 | spindle 6 | spindle 4 | spindle 4 | spindle 4 | spindle 4 | | spindle 4 | spindle 4 |
| Initial | 270 | 12600 | 60 | 60 | 140 (110) | 1710 | 120 | 50 | 220 |
| Day 1 | — | 14800 | 100 | 140 | 220 (190) | — | 190 | | |
| Week 1 | — | | 120 | 270 | 360 (290) | 1590 | 420 | | |
| Week 2 | — | | 150 | 380 | 470 | 1610 | | 730 | 730 |

TABLE 13-continued

| Physical | Composition | | | | | | | | |
|---|---|---|---|---|---|---|---|---|---|
| Properties | #21 | #9 | #52 | #53 | #12 | #37 | #56 | #57 | #58 |
| Week 3 | 240 | | 160 | 520 | (410) 560 (520) | 1550 | | | |
| Week 4 | | | 170 | 550 | 640 (640) | 1440 | | | |
| Week 7 | | | — | — | 1730 (950) | | | | |
| Week 8 | | | 330 | — | | | | | |
| Week 9 | | | | 980 | | | | | |

A freshly prepared 25% dispersion of Varisoft-510 in conjunction with Armosoft 420-90.(composition 12) shows a product activity of 35 EQ. A product activity of 7EQ was observed for a freshly prepared sample at 5% use level. However, a product activity of ~6.5 EQ was observed for a seven week old diluted sample (5%) of composition 12.

With regard to the viscosity profile , sample #12 exhibited a seven week viscosity of only 950 cP, however, another sample showed a viscosity of 1730 cP. Both of these samples exhibited similar softening. The unique combination of Varisoft-510 (2.5%) with Armosoft 420-90 (2.5%) at 5% level shows a synergistic softening of 10EQ (composition 47, Table 11)). In contrast 5% dispersion of Armosoft 420-90 (composition 45) gives a product activity of <2EQ. This low level of softening was not related to the relatively bigger average particle size (16.39 μm). For example, there was no improvement in the softening for a homogenized sample in which the pH was adjusted to 2.13 (composition 45). So inherently Armosoft 420-90 exhibits poor softening. Table 11 also shows the product activity of Varisoft-510 dispersion at 3.5 or 5% level. A product activity of 5EQ was observed for composition 49. Composition 6 was prepared by the addition of oil into water. In contrast to #49, composition 44 was prepared by the addition of water into oil and gave a product activity of only 4–5 EQ. This may imply that the softening performance of Varisoft-510 dispersion is very sensitive to the conditions of preparation.

The increase in the concentratability of the cationic dispersions is believed to result from a reduction in the crystallinity of Varisoft-510 by Armosoft 420-90 (and also Varisoft-512). Evidence in support of this theory is provided by Differential Scanning Calorimetric (DSC) analysis of Varisoft-510 and a mixture of Varisoft-510 and Armosoft 420-90. Thermogram of Varisoft-510 shows a melting temperature of 65.98° C. ($\Delta H$=121.1 $Jg^{-1}$). In contrast a 1:1 mixture of Varisoft-510 and Armosoft 420-90 exhibits a melting temperature of only 58.43° C. ($\Delta H$=51.48 $Jg^{-1}$). Therefore, Armosoft 420-90 apparently serves as a dissolving matrix for the crystalline Varisoft-510. Similarly, Varisoft-512 effects the crystallinity of Varisoft-510, however, such dispersions do not show high softening efficacy. In contrast, mixtures of Varisoft-510 and Armosoft 420-90 show excellent softening characteristics. This is probably due to the additional ability of the imidazolinium nitrogen to hydrogen bond with the hydroxyl groups of the cellulose which is in contrast to the lack of electron pair density on the tertiary nitrogen of Varisoft-510 (protonated nitrogen). The electron pair on imidazolinium nitrogen could also interact with the weakly acidic hydrogen (EO-group) of Varisoft-510. This interaction could result in the formation of a totally new complex (Varisoft-510—OH —N-Imidazolinium salt, see below) in which the flexibility of the soft tallow groups is restricted and which in turn imparts a higher softening:

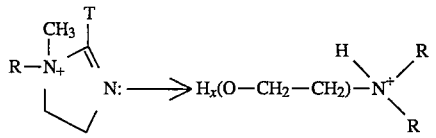

Having described the invention including several embodiments thereof it will be readily apparent to the skilled practitioner that other modifications and variations are also within the scope and spirit of the invention and that the foregoing examples are given for purposes of illustration only, and not by way of limitation.

We claim:

1. A stable, aqueous, free flowing, pourable and water dispensable fabric softener composition comprising:

(A) a fabric softening effective amount of an inorganic or organic acid salt per formula (I):

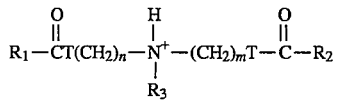

(I)

wherein $R_1$ and $R_2$, independently, represent $C_{12}$ to $C_{30}$ alkyl or alkenyl, $R_3$ represents $(CH_2CH_2O)_pH$, T represents NH, n=1 to 5, m=1 to 5, and p=1.5 to 3.5;

(B) a viscosity controlling and softening improving effective amount of a cyclic imidazolinium compound of formula (II):

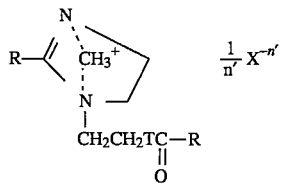

(II)

wherein each R represents an alkyl or alkenyl group having from 12 to 20 carbon atoms, and T represents NH, and X represents a counter-anion of valence n';

(C) an aqueous solvent including an anti-gelling effective amount of electrolyte;

(D) the weight ratio of formula (I) formula (II) is from about 1:0.7 to about 0.7 to 1; and (E) the total amount of (A) and (B) is in the range of from about 2 to about 35% by weight based on the total composition.

2. The fabric softener composition of claim 1, wherein in the compound of formula (I), $R_1$ and $R_2$=$C_{16}$ to $C_{22}$ alkyl, m=1 to 3, n=1 to 3.

3. The composition of claim 1 wherein, the total amount of (A) and (B) ranges from about 12% to about 30% by weight based on the total composition.

4. The composition of claim 1 wherein the weight ratio of (A):(B) is in the range of from about 0.9:1 to 1:0.9.

5. The composition of claim 4 wherein, the total amount of (A) and (B) is in the range of from about 5% to about 25% by weight.

6. The composition of claim 1 wherein the aqueous solvent comprises water and up to about 8%, based on the total composition, of a lower alkanol of from 2 to 4 carbon atoms.

7. The fabric softening composition of claim 1 which further comprises up to about 2% by weight of a $C_{12}$ to $C_{24}$ fatty alcohol.

8. The fabric softening composition of claim 1 wherein the electrolyte comprises one or more water soluble inorganic salts.

9. The fabric softening composition of claim 8 wherein the inorganic salt is NaCl, $CaCl_2$ or mixture thereof.

10. The fabric softening composition of claim 1 wherein the composition further comprises a coloring effective amount of dye.

11. The fabric softening composition of claim 1 wherein the composition further comprises perfume.

12. A method of imparting softness to fabrics comprising contacting the fabrics with a softening effective amount of the fabric softener composition of claim 1.

13. The method of claim 12 wherein said contacting is in the rinse cycle of an automatic laundry washing machine.

* * * * *